US006672407B2

(12) United States Patent
Streich

(10) Patent No.: US 6,672,407 B2
(45) Date of Patent: Jan. 6, 2004

(54) METHOD OF DRILLING, ANALYZING AND STABILIZING A TERRESTRIAL OR OTHER PLANETARY SUBSURFACE FORMATION

(75) Inventor: Steven George Streich, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 22 days.

(21) Appl. No.: 09/956,720

(22) Filed: Sep. 20, 2001

(65) Prior Publication Data

US 2003/0051916 A1 Mar. 20, 2003

(51) Int. Cl.[7] ..... E21C 51/00; E21B 19/20; E21B 19/22

(52) U.S. Cl. ..... 175/58; 175/5; 175/11; 175/20; 166/338; 405/190

(58) Field of Search ..... 175/18, 20, 58, 175/8, 9, 10, 5; 166/338; 405/190, 191; E21C 51/00

(56) References Cited

U.S. PATENT DOCUMENTS 3,353,364 A * 11/1967 Blanding et al. ..... 405/189
3,442,339 A * 5/1969 Williamson ..... 175/6
3,602,301 A * 8/1971 James ..... 166/338
3,635,183 A * 1/1972 Keatinge ..... 114/330
3,670,830 A * 6/1972 Van Der Wijden ..... 175/52
3,812,922 A * 5/1974 Stechler ..... 175/6
3,891,037 A * 6/1975 Well et al. ..... 175/6
4,136,524 A 1/1979 Holman ..... 405/131
5,735,355 A * 4/1998 Bussod et al. ..... 175/11
5,802,126 A * 9/1998 Matsumoto et al. ..... 376/260
6,003,598 A * 12/1999 Andreychuk ..... 166/76.1
6,026,911 A * 2/2000 Angle et al. ..... 175/24
6,178,670 B1 * 1/2001 Susman et al. ..... 37/313
6,276,454 B1 * 8/2001 Fontana et al. ..... 166/343
6,394,192 B1 * 5/2002 Frazer ..... 175/58

OTHER PUBLICATIONS

R.J. Hanold et al, "Rapid Excavation by Rock Melting", los alamos scientific laboratory of the University of California (1977).

* cited by examiner

*Primary Examiner*—David Bagnell
*Assistant Examiner*—T. Shane Bomar
(74) *Attorney, Agent, or Firm*—Gonley Rose, P.C.

(57) ABSTRACT

The present invention provides a method for drilling, analyzing, and stabilizing subsurface formations. The system is generally formed around a reusable bottomhole assembly (BHA) that provides an anchoring and thrust mechanism, furnishing the necessary downward force needed to provide comminution of geological material in a borehole. The BHA is conveyed into the borehole via a communications link wireline equiped with internal power and data telemetry lines. The BHA permits the use of multiple comminution sampling and analysis tools via a coupling device. The BHA and communications link wireline are mounted so as to couple with different tools. The main drilling mechanism is a torque drive assembly powered coring tool. A borehole televiewer and/or logging analysis tool may follow each coring period. The final step in each coring period is a wellbore consolidation technique. This series of steps is then repeated, each time coring the wellbore to a deeper depth.

29 Claims, 2 Drawing Sheets

METHOD OF DRILLING, ANALYZING AND STABILIZING A TERRESTRIAL OR OTHER PLANETARY SUBSURFACE FORMATION

FIELD OF THE INVENTION

The present invention relates to a remote-controlled method of drilling, analyzing, and stabilizing a subsurface formation. More particularly, the present invention relates to drilling, analyzing, and stabilizing a remotely located subsurface formation.

BACKGROUND OF THE INVENTION

The methods used in exploring formations are of two general types: direct and indirect. Direct methods entail drilling, excavating and sampling. Indirect methods involve chemical analysis and surveys of properties such as radioactivity, reflectivity, gravity, magnetism, seismic waves and heat flow. The indirect approach often begins with radar mapping and photographic surveying from orbiting satellites equipped with optical-mechanical infrared scanners and/or multispectral scanners to reveal characteristics such as groundwater movement, hydrothermal areas, specific types of subcropping rocks associated with mineral concentrations, etc. Physical measurements are widely used in the search for oil and minerals and in building-foundation investigation. Chemical prospecting techniques are commonly employed to measure trace contents of certain elements in rock, water, vegetation, and other surface materials that may indicate the presence of a buried body of ore in a given area.

Traditionally, scientific investigators have relied heavily on physical measurements, particularly of seismic waves, to secure information about Earth's interior and its dynamic processes. For example, during the early 1980s seismic investigations of the Appalachian Mountain region of the United States resulted in important discoveries about continent formation. Additionally, exploration of the seafloor and its gravitational and magnetic properties has contributed to the development and widespread acceptance of plate tectonics, a concept that has not only revolutionized scientific understanding of the Earth's dynamic features but has led to the discovery of rich deposits of valuable metals on the ocean bottom as well.

Because indirect methods are applied to the surface of a formation, data must be extrapolated to reveal information about the formation interior. Direct methods, however, are applied to the surface and subsurface of a formation. As a result, information obtained from direct sampling is more precise and thus direct sampling is preferred.

Direct sampling, generally by means of boreholes, is often required in order to make positive identification of substances and to determine the extent of their presence, as well as to choose appropriate methods of recovery. Unfortunately, drilling and other techniques of direct exploration have typically been less significant in the scientific study of remotely located formations, because of the high cost and limited technology available. Therefore, there exists a need to provide a cost-effective method and apparatus that allows direct autonomous sampling of remotely located formations.

SUMMARY OF THE PRESENT INVENTION

In order to support theories based on information obtained from indirect methods, direct sampling data is needed. The present invention provides an unmanned, remote-controlled method, system and apparatus for drilling, analyzing, and stabilizing subsurface formations.

In accordance with a preferred embodiment of the present invention, a remotely operable drilling apparatus for investigating a formation includes a landing craft disposed upon the formation, a bottomhole assembly in communication with the landing craft through a communications link wireline. The preferred bottomhole assembly includes a borehole gripping mechanism, an extension/retraction mechanism, a torque drive assembly, a coupling mechanism, and a tool.

In accordance with an alternate preferred embodiment of the present invention, a remote drilling method includes deploying a landing craft to the surface of the formation, deploying a bottomhole assembly from the landing craft to the formation, and drilling, logging, and sampling using equipment provided on the landing craft.

BRIEF DESCRIPTION OF THE DRAWINGS

A better understanding of the present invention can be obtained when the following detailed description of the preferred embodiment is considered in conjunction with the following drawings.

DETAILED DESCRIPTION OF PREFERRED EMBODIMENTS

The following detailed description describes a preferred embodiment for implementing the underlying principles of the present invention. One skilled in the art should understand, however, that the following description is meant to be illustrative of the present invention, and should not be construed as limiting the principles discussed herein. In addition, certain terms are used throughout the following description and claims to refer to particular system components. As one skilled in the art will appreciate, manufacturers may refer to a component by different names. This document does not intend to distinguish between components that differ in name but not function. In the following discussion and in the claims, the terms "including" and "comprising" are used in an open-ended fashion, and thus should be interpreted to mean "includes, but is not limited to . . . ". Also, the term "couple" or "connect" is intended to mean either an indirect or direct connection. Thus, if a first device couples or connects to a second device, that connection may be through a direct connection, or through an indirect connection via other devices and connections.

While one of ordinary skill in the art will appreciate that the principles of the present invention may be applied to any remotely-located subsurface formation, a preferred embodiment of the present invention applies the principles of this invention to extraterrestrial formations, and more particularly to Mars.

Figure 1:
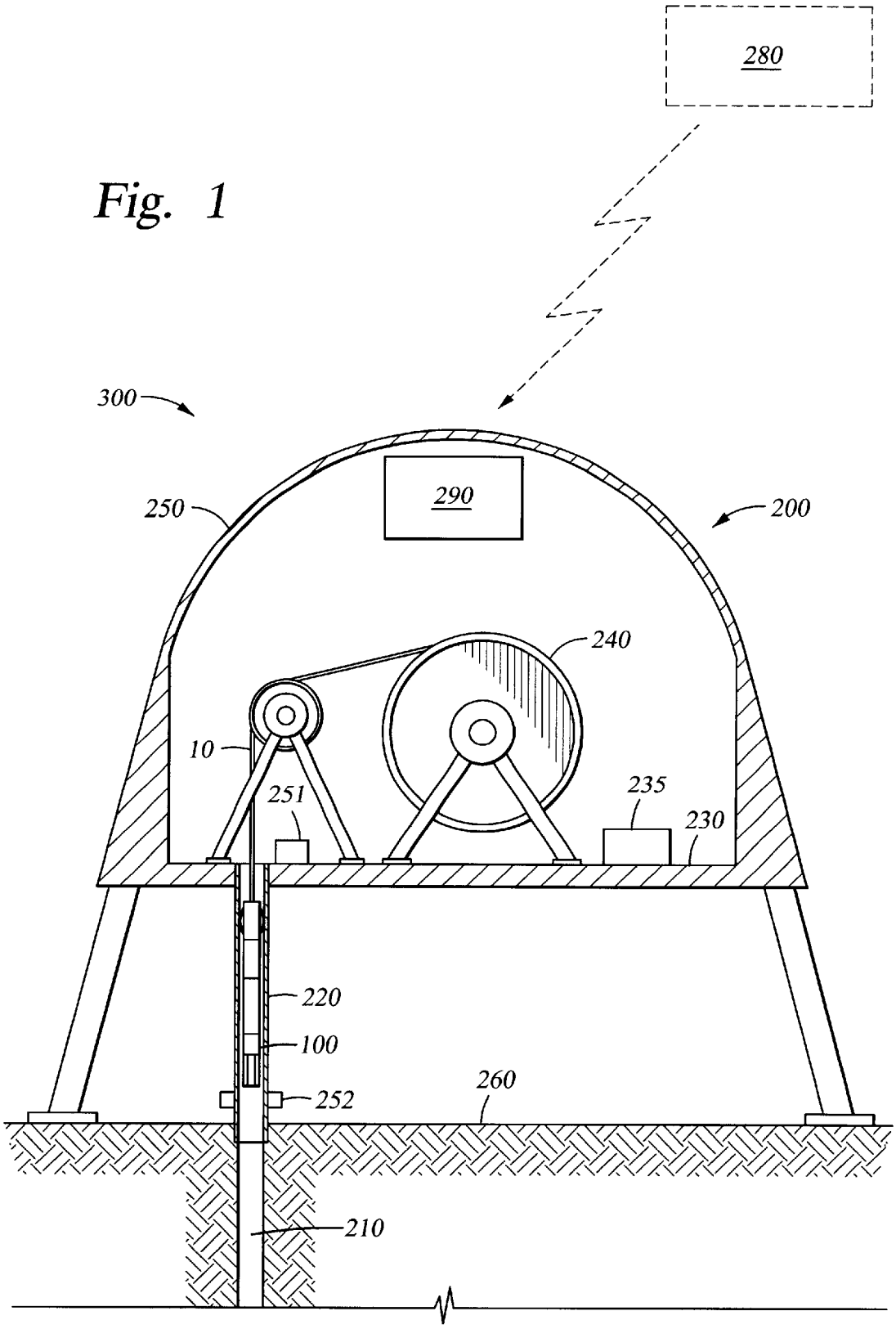
FIG. 1 is a schematic of a landing craft assembly constructed in accordance with a preferred embodiment of the present invention.

Referring initially to FIG. 1, the present remotely deployable and operable drilling apparatus 300 includes a landing craft assembly 200 positioned on top of formation 260. Landing craft assembly 200 preferably includes a landing craft 250, a communications link/wireline 10, a bottomhole assembly (BHA) 100, and a microprocessor 290. While the various components of drilling apparatus 300 are preferably controlled by microprocessor 290, in some embodiments, additional control signals may come from a remote control site 280. In these instances, the signals are received and/or transmitted by a transceiver (not shown).

Landing craft 250 includes a wireline reel 240, a rotating base 230, and a spring loaded starter tube 220. Reel 240 is preferably mounted on top of rotating base 230. Rotating base 230 is located at the bottom of landing craft 250 and preferably serves as the floor of landing craft 250. Rotating base 230 is preferably rotated by a small indexing motor 235. Communications link/wireline 10 is stored on reel 240 and is preferably coupled to BHA 100, such that the top of BHA 100 engages the bottom of communications link/wireline 10. Spring loaded starter tube 220 preferably fits into an opening in base 230, and extends outwardly from landing craft 250.

The term "landing craft" is herein defined as a mobile structure capable of supporting drilling equipment during drilling. In some embodiments, landing craft 250 is also capable of transporting drilling equipment, such as when landing craft 250 comprises a remotely operated vehicle or spacecraft. In some embodiments, landing craft 250 additionally may include analysis and/or communication equipment 251. The analysis equipment 251 is preferably located inside landing craft 250 near reel 240. Additionally, landing craft 250 may optionally include a blowout preventor (BOP) 252, such as are known in the drilling arts. The blowout preventer 252 may be located at the bottom of starter tube 220, as shown, at the top of starter tube 220, inside landing craft 250, or at the top of BHA 100 and may be a RAM or an annular type BOP.

In a preferred embodiment, microprocessor 290 employs Remote Agent™ software available from Johnson Space Center, Houston, Tex., to control excavation tasks performed by the drilling apparatus 300. In some embodiments, microprocessor 290 is wholly autonomous and in other embodiments, microprocessor receives control signals and sends feedback to a remote control site 280 via a transceiver. Unlike drilling apparatus 300, which may be deployed at an extra-terrestrial or similarly remote location, remote control site 280 is preferably located in an easily accessible area. Remote control site 280 may comprise a communications satellite, a laboratory, or a platform.

Figure 2:
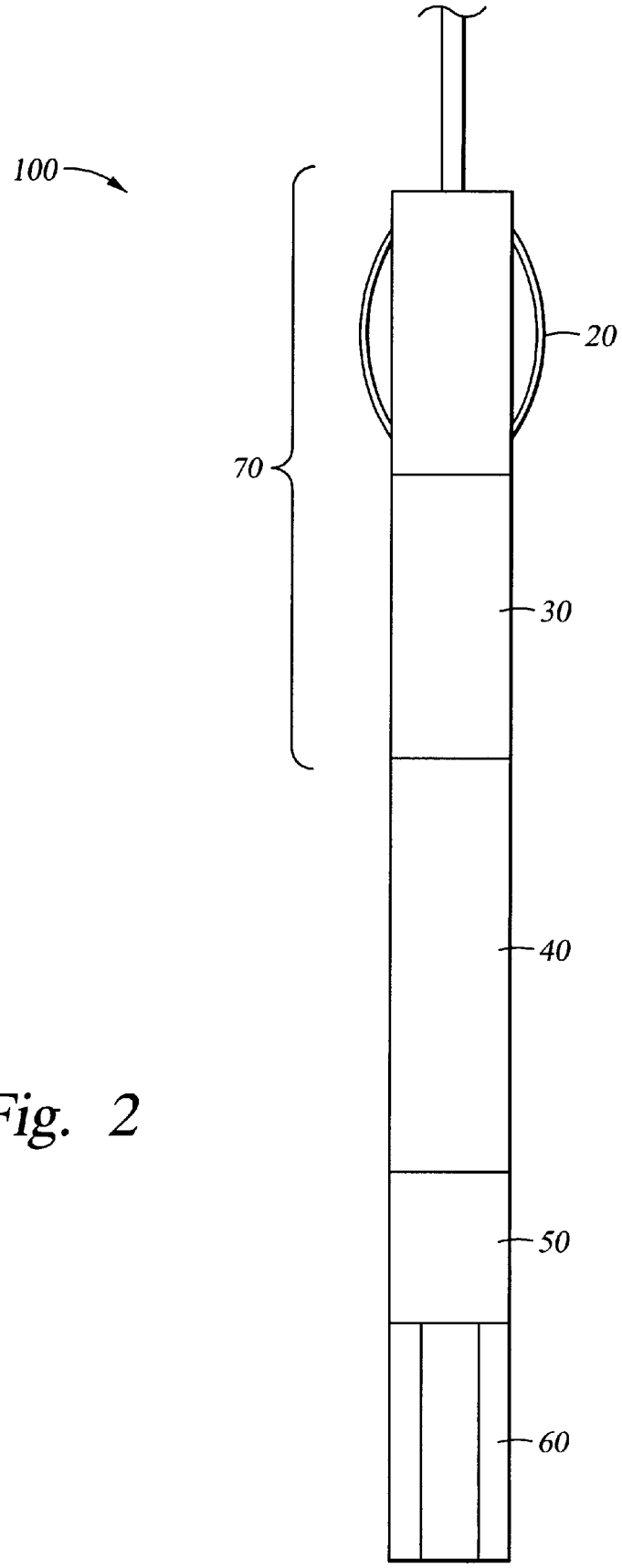
FIG. 2 is a schematic of a bottomhole assembly configured for use with the landing craft of FIG. 1.

Referring now to FIG. 2, BHA 100 includes a borehole gripping mechanism 20, an extension/retraction mechanism 30, a torque drive assembly 40, a coupling mechanism 50 and a tool 60. Borehole gripping mechanism 20 is preferably coupled to the upper end of extension/retraction mechanism 30, while the lower end of extension/retraction mechanism 30 is coupled to the upper end of torque drive assembly 40. The lower end of torque drive assembly 40 is in turn coupled to coupling mechanism 50, which is coupled to a tool 60. In a preferred embodiment, the components of BHA 100 are coupled to each other by electrically controlled clamping mechanisms. In a preferred embodiment, coupling mechanism 50 is coupled to torque drive assembly 40 via conventional multi-pronged connectors and latching mechanisms.

While tool 60 is shown as a coring bit, it may be any type of well tool, including but not limited to, a drill bit, a televiewer, a logging/analysis tool, or a wellbore stabilization (WBS) tool. In a preferred embodiment of the invention, a desired selection of such well tools is stored on board landing craft 200 and positioned such that each tool can be selectively engaged by coupling mechanism 50 when wireline 10 is retracted. Coupling mechanism 50 allows utilization of these various drilling and analysis tools by allowing the BHA to exchange tools at the surface and take each tool into the hole as desired. Coupling mechanism 50 is preferably similar to technology utilized in numerically controlled turret lathes and mills. The indexing head on these machines can exchange machine tools on a regular basis.

Operation

Initially, landing craft 250 is positioned on formation 260. Spring loaded starter tube 220 is extended from rotating base 230 to the surface of formation 260. Once the lower end of tube 220 is positioned against the surface, rotating base 230 rotates into a position that allows communications deployment apparatus 240 to extend/retract communications link/wireline 10 and BHA 100 into starter tube 220. Starter tube 220 provides a continuous conduit for BHA 100 to advance between landing craft 250 and formation 260. Because rotating base 230 utilizes a small indexing motor 235, it has the ability to position itself such that BHA 100 can exchange tools for various comminution and analysis operations whenever the communications link/wireline 10 is retracted.

Communications link/wireline 10 provides a compact, lightweight conveyance mechanism of all the tools used during the operations. In a preferred embodiment, communications link/wireline 10 comprises braided cable, equipped with internal power and telemetry lines. Coil tubing with power and telemetry lines could alternatively be used. Communications link/wireline 10 eliminates the need for jointed pipe handling operations, which are difficult to automate and control, and furnishes power and telemetry to and from BHA 100 during drilling and analysis operations. BHA 100 can be lowered and raised with the wireline cable precisely and easily through the use of various sensors that provide remote control site 280 with precise locations and positions for coupling to various tools.

BHA 100 is lowered into starter tube 220 by communications link/wireline 10. Once at the bottom, gripping mechanism 20 is extended radially so that it grips the inside wall of starter tube 220. Gripping mechanism 20 preferably includes packers and/or slips 20 that aid in gripping starter tube 220. Extension retraction mechanism 30 advances tool 60 into formation 260. Extension/retraction mechanism 30 applies a downward force to tool 60 and thus causes it to advance into the formation.

As it advances into formation 260, tool 60, which can comprise, for example, a coring barrel, begins to drill a borehole 210. Torque drive assembly 40 provides a compact, lightweight power mechanism capable of providing the torque required for comminution operations, such as drilling. Torque drive assembly 40 is preferably an electric motor that provides rotational force to drive a pin (not shown), which is connected to and drives tool 60.

The coring barrel collects formation while it drills. At this stage, borehole-gripping mechanism 20 grips tube 220 and provides the anchoring force for extension/retraction mechanism 30. As it extends, extension/retraction mechanism 30 bears against borehole-gripping mechanism 20 and tool 60, providing an effective weight on bit (WOB). In a preferred embodiment, extension/retraction mechanism 30 operates similarly to a screw jack or hydraulic jack. In the drilling arts, WOB provides the downward force needed for the bit to cut into the formation. WOB is typically gravity dependent. However, because extraterrestrial locations may be low gravity environments, the gripping mechanism and extension/retraction mechanism 30 are provided to ensure that sufficient downward force is applied to tool 60. In a preferred embodiment, borehole 210 is at least 25 mm in diameter.

Because the preferred coring barrel is approximately one foot long, it becomes full relatively quickly. Once the barrel is full, gripping mechanism 20 is returned to its initial diameter, thereby releasing its engagement with the borehole wall, and BHA 100 is retracted back up through borehole 210 into craft 250. Extension/retraction mechanism 30 is retracted. Coupling mechanism 50 decouples the barrel.

Inside craft 250, a sample is removed from the coring barrel by a robot arm. The robot arm transfers the sample to an analysis machine. In a preferred embodiment the coring samples are approximately 150–300 mm in length. The chamber may optionally be equipped with various instruments for visual (microscopy) and elemental analysis. Following analysis, the sample can be ejected from the chamber via a spring mechanism or other device or be retained for future analysis.

In the present example, where a drill bit is utilized, coring was selected as the preferred comminution method for the following reasons. It provides the most complete record of the subsurface geology and lithology, which should be of extreme value both scientifically and for future deep drilling activities. This method also provides for complete cutting's transport and disposal without the need for circulating compressed gas or other fluids. In some instances, it may be desirable to blow compressed gaseous atmosphere through the hole to clear the cuttings. The coring process utilized in 150–300 mm long samples may also eliminate the need for lubricating fluids or gases, which require additional payload. To attempt longer samples may place the mission in jeopardy by putting the downhole drill assembly in a position to become stuck in the hole. Another reason for coring in short intervals lies in the ability to remove the core from the coring barrel after it is returned to the surface. The shorter the sample, the easier and more reliable it will be to remove it. Hence, a short barrel coring bit is preferred for the present application. Regardless of the bit type(s) selected for the present application, replacement bits can be provided on the mission to insure against damaged bits. These can be changed out whenever necessary.

While analysis of the cores can be accomplished at the surface, standard oil field logging methods may also provide a quick reliable source of information for the geologists and scientists. For example, after BHA 100 is removed from borehole 210, coupling mechanism 50 may engage a small diameter logging tool (not shown) in place of tool 60. A small-diameter logging tool can be utilized to acquire additional information about the formation.

Communications link/wireline 10 advances BHA 100 and the small diameter-logging tool into hole 210. The logging tool acquires well data that is used to characterize the surrounding formations and operation of the well. The logging tool is retracted and decoupled from BHA 100 in craft 250.

A televiewer is preferably then coupled to BHA 100 and advanced into borehole 210. The televiewer provides a visual survey of the wellbore. The use of a televiewer is extremely useful to geologists studying the remote formation's subsurface. Visual inspection after each coring operation provides geologists with a wealth of information. Further visual inspection after wellbore consolidation (discussed later) may also provide valuable information for safety of the next coring operation. If the borehole is not fully stabilized, the BHA could become stuck in the hole and end the mission. Visual inspection of the boreholes may provide mission planners and remote control site 280 with information that could prevent the BHA and coring barrel from becoming stuck.

Once enough information is obtained, the televiewer is retracted and decoupled from BHA 100 in craft 250.

A wellbore stabilization (WBS) tool is preferably then coupled to BHA 100 and advanced into borehole 210. In a preferred embodiment, the WBS tool comprises a thermal melting system, or rock melting penetrator. The WBS tool heats the formation walls to temperatures in excess of 1400° C. to ensure a thorough melt. This action provides a "casing-effect" for the wellbore; it allows subsequent trips into the wellbore without the threat of the formation collapsing into the wellbore. The melt is preferably performed on the area from the surface to the bottom of the wellbore. In a preferred embodiment, the melt may enlarge the drilled wellbore by 5–8 mm, providing unhindered access to the borehole during subsequent operations. Once completed, the WBS tool is retracted and decoupled from BHA 100. Rock melting also may solidify any cuttings that are left in the bottom of the hole. For example, see U.S. Pat. No. 4,136,524 and "Rapid Excavation by Rock Melting, LASL Subterrene Program, September 1973-June 1976" by R. J. Hanold, LA-5979-SR Status Report, Los Alamos Scientific Laboratory of the University of California, February 1977, both of which are incorporated herein by reference.

Wellbore stabilization is preferably employed in remote drilling to ensure complete mission success. Without this element, the whole mission could be in jeopardy within a few meters of the surface. For example, if the near subsurface of Mars is as desiccated as reported by those in the astrobiological community, then wellbore collapse at some point in the drilling operation is almost certain. Some form of stabilization is paramount. This could be accomplished by the use of a WBS tool that is picked up and run into the hole on the BHA after all the analysis operations are completed. In a preferred embodiment, the Rock Melt process described in the Los Alamos paper cited above provides a solidified lining on the borehole that should provide sufficient wellbore stabilization. This method would also make the hole larger in each cored section, thus providing better clearance for subsequent operations in penetrating the subsurface layers. Other means, such as lasers may also be used to melt rock. Alternatively, chemicals that can be injected, optionally under pressure, into the wellbore accomplish WBS but may not enlarge the hole for subsequent operations. They also require materials to be carried to the remote site and may be limited by weight restrictions and environment issues such as temperature and atmospheric pressure.

Lastly, the coring barrel is recoupled to BHA 100 and returned to borehole 210 to continue drilling. This cycle repeats itself until a sufficient depth is met, or a sufficient number of samples are collected.

In some instances, the present system may be successful in penetrating the remote formation to a depth of 300 m or more without the aid of any WBS techniques. For example, the BHA, tool and communications link/wireline can be used to re-drill any collapsed portions of the hole. However, because WBS is the number one cause of conventional drilling problems, it is likely that these problems will be present in extraterrestrial and other remote locations.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

Numerous variations and modifications will become apparent to those skilled in the art once the above disclosure is fully appreciated. It is intended that the present invention be interpreted to embrace all such variations and modifications. For example, the present invention may have application to sidewall coring and exploratory or other drilling analysis activities. The present invention may additionally be adapted to drill water or other scientific wells in remote locations without the need of a large footprint on the surface of the ground, reducing the impact on environmental sensitive areas.

What is claimed is:

1. A remotely operable drilling apparatus to investigate a formation, the drilling apparatus comprising:

a landing craft disposed upon the formation;

a bottomhole assembly in communication with said landing craft, said bottomhole assembly including a borehole gripping mechanism, an extension/retraction mechanism, a torque drive assembly, a coupling mechanism, and a tool;

a starter tube that forms a continuous conduit from said landing craft to said formation, said starter tube being engageable by said borehole gripping mechanism; and a communications link engaging said landing craft and said bottomhole assembly such that said bottomhole assembly can be extended and retracted from said landing craft.

2. The apparatus of claim 1, wherein the landing craft further includes a rotating base that enables said bottomhole assembly to couple and decouple with different tools.

3. The apparatus of claim 1, wherein the landing craft further includes a reel that stores and extends/retracts said communications link.

4. The apparatus of claim 1, wherein the extension/retraction mechanism can be operated to bear on said tool.

5. The apparatus of claim 1, wherein the torque drive assembly comprises an electric motor.

6. The apparatus of claim 1, wherein the tool comprises a coring bit.

7. The apparatus of claim 1, wherein the tool comprises a logging/analysis tool for acquiring well data that is used to characterize the surrounding formation and operation of the well.

8. The apparatus of claim 1, wherein the tool comprises a televiewer for recording images of the borehole.

9. The apparatus of claim 1, wherein the tool comprises a wellbore stabilization tool for preventing the wellbore from collapsing.

10. The apparatus of claim 9, wherein the wellbore stabilization tool comprises a rock melting penetrator.

11. The apparatus of claim 1, wherein the communications link comprises a wireline cable.

12. The apparatus of claim 1, wherein the communications link comprises a composite tube.

13. The apparatus of claim 1, further including a blowout preventer.

14. The apparatus of claim 1, wherein the landing craft further includes analysis equipment.

15. A remotely operable drilling apparatus to investigate a formation, the drilling apparatus, comprising:

a landing craft disposed upon the formation, said landing craft including a communications link and a reel that stores and extends and retracts said communications link;

a bottomhole assembly in communication with said landing craft through said communications link, said bottomhole assembly including a borehole gripping mechanism, an extension/retraction mechanism, a torque drive assembly, a coupling mechanism, and a tool; and a starter tube that forms a continuous conduit from said landing craft to said formation.

16. The apparatus of claim 15, wherein the landing craft further includes a rotating base that provides rotation of said bottomhole assembly, so as to couple and decouple with different tools.

17. The apparatus of claim 15, wherein the extension/retraction mechanism can be operated to apply a downward force to said tool.

18. The apparatus of claim 15, wherein the torque drive assembly comprises an electric motor.

19. The apparatus of claim 15, wherein the tool comprises a drill bit.

20. The apparatus of claim 19, wherein the tool comprises a coring bit.

21. The apparatus of claim 15, wherein the tool comprises a logging/analysis tool.

22. The apparatus of claim 15, wherein the tool comprises a televiewer.

23. The apparatus of claim 15, wherein the tool comprises a wellbore stabilization tool.

24. The apparatus of claim 23, wherein the wellbore stabilization tool comprises a rock melting penetrator.

25. The apparatus of claim 15, wherein the communications link comprises a wireline cable.

26. The apparatus of claim 15, wherein the communications link comprises a composite tube.

27. The apparatus of claim 15, further including a blowout preventer.

28. The apparatus of claim 15, wherein the landing craft further includes analysis equipment.

29. A method for drilling a remote formation, comprising:

(a) deploying a landing craft on the surface of the formation;

(b) deploying a bottomhole assembly from the landing craft to the formation; and (C) activating a drive assembly to rotate a drilling tool, wherein the drive assembly is part of the bottomhole assembly wherein step (b) includes deploying a starter tube between the landing craft and the surface of the formation and wherein the starter tube forms a continuous sealed conduit from the landing craft to the formation, said starter tube being engageable by said borehole gripping mechanism.

* * * * *